US011117148B2

(12) United States Patent
Zhu

(10) Patent No.: US 11,117,148 B2
(45) Date of Patent: Sep. 14, 2021

(54) PUMP ASSEMBLY AND CONTAINER WITH CONTENTS DISCHARGE FUNCTION

(71) Applicant: NUBIZ PLASTIC (NANTONG) CO., LTD, Qidong (CN)

(72) Inventor: Wei Zhu, Qidong (CN)

(73) Assignee: NUBIZ PLASTIC (NANTONG) CO., LTD, Qidong (CN)

( * ) Notice: Subject to any disclaimer, the term of this patent is extended or adjusted under 35 U.S.C. 154(b) by 0 days.

(21) Appl. No.: 16/902,488

(22) Filed: Jun. 16, 2020

(65) Prior Publication Data

US 2020/0398296 A1 Dec. 24, 2020

(30) Foreign Application Priority Data

Jun. 18, 2019 (CN) ..... 201910526918.2

(51) Int. Cl.
*B05B 11/00* (2006.01)

(52) U.S. Cl.
CPC ..... *B05B 11/3001* (2013.01); *B05B 11/3043* (2013.01); *B05B 11/3052* (2013.01)

(58) Field of Classification Search
CPC ..... B05B 11/3001; B05B 11/3043; B05B 11/3052; B05B 11/3078; B05B 11/0089; B05B 11/3067; B05B 11/3087; B05B 9/0883; B65D 47/20; B65D 2547/063
See application file for complete search history.

(56) References Cited

U.S. PATENT DOCUMENTS 3,361,078 A * 1/1968 Cooprider ..... B05B 11/3001 417/514
4,046,495 A * 9/1977 Grimm, Jr. ..... B05B 11/0075 417/268

(Continued)

FOREIGN PATENT DOCUMENTS

CN 101171088 A 4/2008
CN 105517914 A 4/2016

(Continued)

OTHER PUBLICATIONS

International Searching Authority. International Search Report and Written Opinion for application PCT/CN2020/095126, dated Sep. 2, 2020. With machine translation.

(Continued)

*Primary Examiner* — Vishal Pancholi
*Assistant Examiner* — Bob Zadeh
(74) *Attorney, Agent, or Firm* — Quarles & Brady LLP

(57) ABSTRACT

In a pump assembly, the outer wall of the first inner-housing sidewall, the inner wall of the second inner-housing sidewall and the inner-housing top wall define a first chamber with a first opening, and the gas chamber of the first chamber is a sealed chamber collectively defined by the piston portion, the inner-housing top wall, the outer wall of the first inner-housing sidewall and the inner wall of the second inner-housing sidewall, so that the formation of the sealed chamber does not require an additional sealing ring. This thereby reduces the risk of gas leakage due to aging of the sealing ring. A container with contents discharge function provided by this disclosure can include the above pump assembly.

10 Claims, 12 Drawing Sheets

(56) References Cited

U.S. PATENT DOCUMENTS

| | | | | |
|---|---|---|---|---|
| 4,286,736 | A * | 9/1981 | Corsette | B05B 11/306 222/153.13 |
| 4,317,531 | A | 3/1982 | Saito | |
| 5,881,927 | A * | 3/1999 | Inagawa | B05B 11/3097 222/321.7 |
| 2020/0398296 | A1* | 12/2020 | Zhu | B05B 11/3043 |

FOREIGN PATENT DOCUMENTS

| | | | |
|---|---|---|---|
| CN | 109290087 | A | 2/2019 |
| CN | 109649819 | A | 4/2019 |
| CN | 110155489 | A | 8/2019 |
| CN | 210140105 | U | 3/2020 |
| EP | 1083002 | A2 | 3/2001 |
| EP | 1083002 | A3 | 6/2006 |
| FR | 2434943 | A1 | 3/1980 |

OTHER PUBLICATIONS

European Patent Office. Extended European Search Report for application 20180146.1, dated Oct. 30, 2020. 8 pages.

* cited by examiner

PUMP ASSEMBLY AND CONTAINER WITH CONTENTS DISCHARGE FUNCTION

CROSS-REFERENCE TO RELATED APPLICATIONS

This application claims priority to Chinese Patent Application No. 201910526918.2 filed Jun. 18, 2019, the disclosure of which is hereby incorporated by reference for all purposes.

STATEMENT CONCERNING FEDERALLY SPONSORED RESEARCH OR DEVELOPMENT

Not applicable.

TECHNICAL FIELD

This disclosure relates to a pump assembly and a container with contents discharge function.

BACKGROUND

Containers with contents discharge function are often used in daily life, e.g., bottles containing contents such as cosmetics, shampoos, detergents, or medicines. Such a container with contents discharge function comprises a container body, a pump assembly, a cap, and an extension pipe.

The container body has a liquid filling port for filling contents. The pump assembly comprises a pump main body and a press rod, wherein the pump main body is detachably provided in the liquid filling port in a penetrating manner, the press rod is mounted on the pump main body and the upper end thereof protrudes from the pump main body, and the cap is mounted to the upper end of the press rod. One end of the extension pipe is connected at the pump main body, and the other end thereof extends to below the liquid level of the contents.

The cap is configured to be pressed by the user, so as to press the press rod down relative to the pump main body, so that the contents remaining in the pump main body can be discharged from the pump main body via channels inside the press rod and the cap. After the press rod is pressed down in place, the press rod needs to rebound such that the press rod is adapted to be re-pressed, and during rebounding, the press rod can also drive the pump main body to suck in the contents in the container body through the extension pipe. In the prior art, a spring is provided inside the pump main body, and the press rod compresses the spring during being pressed down. When the external force is removed, the spring enables the press rod to rebound. Regarding the operating principle of the aforementioned pump assembly with a spring, reference can be made to the disclosure in patent document CN105517914A.

In the prior art, since the spring is made of metal material, parts of the pump assembly except the spring are made of plastic material, which poses a problem for recycling the pump assembly as plastics packaging waste. Most countries' plastics packaging waste recycling standards require that plastic and metal to be recycled separately. However, when the aforementioned pump assembly is recycled as plastics packaging waste, the spring is not easily removed because it is tightly mounted inside the pump main body. As a result, the pump assembly in the prior art is not easily recycled but can only be discarded as waste.

In order to solve the technical problem that the pump assembly is not easily recycled, the Chinese patent CN201910036365.2 discloses a pump assembly and a container with contents discharge function. The piston portion of the pump assembly can rebound under action of the resultant force of the gas pressure in the first gas chamber and the gas pressure in the second gas chamber, so as to drive the rod body to rebound. Therefore, the pump main body does not need to be provided with a spring for rebounding the rod body, so that the pump assembly can be entirely made of plastic material, and no metal material is mixed, so that the pump assembly is easily recycled.

However, the pump assembly disclosed in Chinese patent CN201910036365.2 adopts a sealing ring to seal the gap between the first access hole and the rod body. This sealing manner has a poor sealing effect, easily causing gas leakage.

SUMMARY

An object of this disclosure is to provide a pump assembly, which has the advantage of having good sealing effect.

A further object of this disclosure is to provide a container with contents discharge function, comprising the aforementioned pump assembly.

A pump assembly for achieving the object is adapted to be mounted on a container body, and comprises a pump main body and a press rod, wherein, the pump main body comprises an inner housing.

The inner housing has an inner-housing top wall, a first inner-housing sidewall and a second inner-housing sidewall; the inner-housing top wall has a first through-hole, the first inner-housing sidewall and the second inner-housing sidewall being respectively connected at the inner-housing top wall, wherein the inner wall of the first inner-housing sidewall defines an access channel which communicates with the first through-hole; the second inner-housing sidewall encircles the first inner-housing sidewall; the outer wall of the first inner-housing sidewall, the inner wall of the second inner-housing sidewall and the inner-housing top wall define a first chamber with a first opening.

The press rod has a rod body, a connecting portion and a piston portion, the inner wall of the rod body defines a discharge channel; the rod body is provided in the first through-hole and the access channel in a penetrating manner; the piston portion is provided in the first chamber and slidably contacts with an outer wall of the first inner-housing sidewall and an inner wall of the second inner-housing sidewall in a sealing manner respectively, such that a first gas chamber and a second gas chamber are separated in the first chamber, wherein the first gas chamber is a sealed chamber collectively defined by the piston portion, the inner-housing top wall, the outer wall of the first inner-housing sidewall and the inner wall of the second inner-housing sidewall, and the second gas chamber communicates with the first opening; one end of the connecting portion is connected with the rod body, and the other end extends into the second gas chamber via the first opening and is connected with the piston portion.

The rod body is configured to be pressed, so as to drive the piston portion to expand the first gas chamber and compress the second gas chamber, so that the contents in the container body is discharged via the discharge channel; the piston portion is configured to rebound under action of the resultant force of the gas pressure in the first gas chamber and the gas pressure in the second gas chamber, so as to drive the rod body to rebound, so that the rod body is adapted to be re-pressed.

In one embodiment, the pump main body has a gas guide channel which communicates with the second gas chamber;

and the gas is discharged from or sucked into the second gas chamber through the gas guide channel.

In one embodiment, the pump main body further comprises an outer housing which surrounds the second inner-housing sidewall.

The outer wall of the second inner-housing sidewall is fitted to the inner wall of the outer housing in a surface-to-surface contact manner, wherein the inner wall of the outer housing is recessed to form the gas guide channel.

In one embodiment, the connecting portion has a connecting-portion bottom wall and a connecting-portion sidewall; the connecting-portion bottom wall has a second through-hole.

The lower end of the rod body is connected at the connecting-portion bottom wall, wherein the second through-hole communicates with the discharge channel; one end of the connecting-portion sidewall is connected with the connecting-portion bottom wall, and the other end extends into the second gas chamber via the first opening and is connected with the piston portion.

In one embodiment, the connecting-portion sidewall encircles the rod body; the outer wall of the rod body, the inner wall of the connecting-portion sidewall and the connecting-portion bottom wall define a second chamber with a second opening.

The first inner-housing sidewall extends into the second chamber via the second opening.

In one embodiment, the pump main body further comprises a piston member which has a piston body and a liquid guide tube; the liquid guide tube has a liquid guide channel.

The piston body is slidably fitted to the inner wall of the outer housing in a sealing manner, to define a contents chamber in the outer housing; one end of the liquid guide tube is connected with the piston body, wherein one end of the liquid guide channel communicates with the contents chamber; the other end of the liquid guide tube extends into the second through-hole and the discharge channel, and is fixedly connected with the inner wall of the rod body in a sealing manner, wherein, the other end of the liquid guide channel communicates with the discharge channel.

In one embodiment, a protrusion is provided on the outer wall of the second inner-housing sidewall; the inner wall of the outer housing is recessed to form a hang slot.

The gas guide channel extends along the axial direction of the outer housing, the hang slot extends along the circumferential direction of the outer housing, and the gas guide channel communicates with the hang slot.

The protrusion is slidingly fitted to the gas guide channel in the axial direction of the outer housing, and is slidingly fitted to the hang slot in the circumferential direction of the outer housing.

In one embodiment, a protruding line is provided on the bottom surface of the hang slot, and the protruding line is configured to be engaged with the protrusion in a clasping manner, to prevent the protrusion from exiting the hang slot.

In one embodiment, the inner wall of the first through-hole and/or the inner wall of the first inner-housing sidewall are provided with teeth; the outer wall of the rod body has a slide slot, which extends along the axial direction of the rod body and is slidingly fitted to the teeth.

The rod body is configured to be rotated in the radial direction, thereby driving the inner housing to rotate.

A container with contents discharge function for achieving the further object comprises a container body and further comprises a pump assembly as described above, the pump assembly being mounted on the container body and configured to discharge the contents in the container body.

This disclosure has positive and advanced effects in that: according to the pump assembly provided by this disclosure, since the outer wall of the first inner-housing sidewall, the inner wall of the second inner-housing sidewall and the inner-housing top wall define a first chamber with a first opening, and the gas chamber of the first chamber is a sealed chamber collectively defined by the piston portion, the inner-housing top wall, the outer wall of the first inner-housing sidewall and the inner wall of the second inner-housing sidewall, the formation of the sealed chamber does not require an additional sealing ring, thereby reducing the risk of gas leakage due to aging of the sealing ring. The container with contents discharge function provided by this disclosure comprises the aforementioned pump assembly.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

The above and other features, characteristics and advantages of this disclosure will become more apparent from the following description in conjunction with the figures and implementations, wherein.

DETAILED DESCRIPTION OF THE PREFERRED EMBODIMENT

Figure 1:
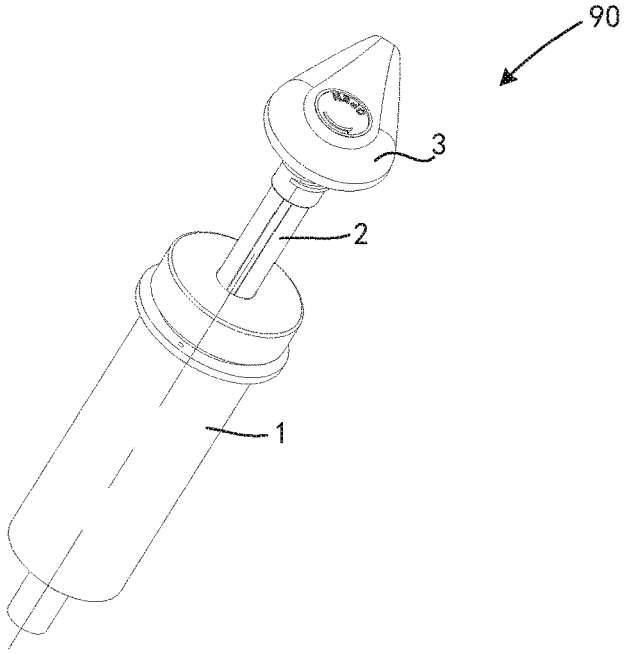
FIG. 1 is a schematic view of the pump assembly.
Figure 2:
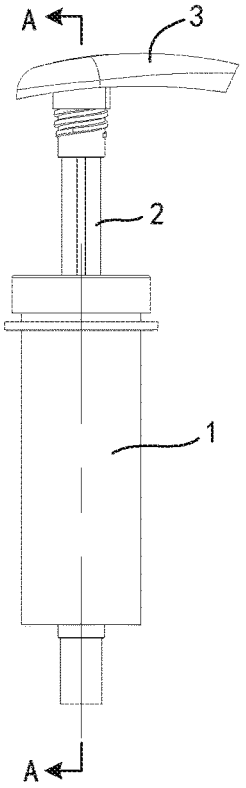
FIG. 2 is a side view of the pump assembly.

This disclosure will be further described below in conjunction with specific embodiments and the accompanying drawings, and more details are set forth in the following description for the ease of fully understanding this disclosure. However, this disclosure can obviously be implemented in various different manners than that described herein, the skilled in the art can make a similar extension and deduction without departing from the connotation of this disclosure according to the practical applications, and therefore the protection scope of this disclosure should not be limited to the content of the specific embodiments herein.

Various embodiments or implementations implementing the subject technical solution are disclosed below. To simplify the disclosure, specific examples of elements and arrangements are described below. Of course, these are only examples, not to limit the protection scope of this disclosure. For example, that the first feature is formed on or above the second feature, subsequently recorded in the specification, may comprise embodiments in which the first and second features are formed by way of direct connection, and embodiments in which additional features are formed between the first and second features so that there may be no direct connection between the first and second features. In addition, reference numerals and/or letters may be repeated in different examples in these disclosed. The repetition is intended to be brief and clear, not representing in itself a relationship between the embodiments and/or structures to be discussed. Furthermore, when a first element is described in a way of connecting or combining with a second element, the description comprises embodiments in which the first and second elements are directly connected or combined with each other, and also comprises that one or more other intervening elements are added to indirectly connect or combine the first and second elements with each other.

It should be noted that FIGS. 1 to 29 are merely taken as examples, and are not necessarily drawn to scale, and should not be taken as a limitation to the actually claimed protection scope of this disclosure.

Figure 29:
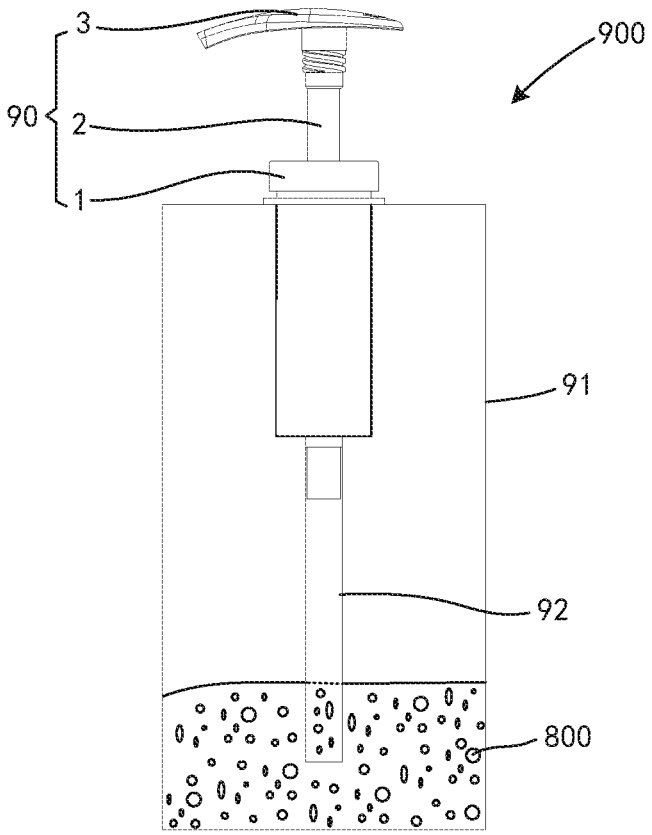
FIG. 29 is a schematic view of the container with contents discharge function.

Referring first to FIG. 29, a container 900 with contents discharge function comprises a container body 91, a pump assembly 90 and an extension pipe 92.

The container body 91 has a liquid filling port for filling the contents 800. The pump assembly 90 comprises a pump main body 1, a press rod 2 and a cap 3. The pump main body 1 is detachably provided in the liquid filling port in a penetrating manner. The press rod 2 is pressably mounted on the pump main body 1 and the upper end thereof protrudes from the pump main body 1. The cap 3 is mounted to the upper end of the press rod 2. One end of the extension pipe 92 is connected at the pump main body 1, and the other end thereof extends to below the liquid level of the contents 800.

The cap 3 is configured to be pressed by the user, so as to press the press rod 2 down relative to the pump main body 1, so that the contents 800 remaining in the pump main body 1 can be discharged from the pump main body 1 via channels inside the press rod 2 and the cap 3. After the press rod 2 is pressed down in place, the press rod 2 needs to rebound such that the press rod 2 is adapted to be re-pressed, and during rebounding, the press rod 2 can also drive the pump main body 1 to suck in the contents 800 in the container body 91 through the extension pipe 92.

To have the press rod 2 rebound, as shown in FIGS. 1, 2, 3, 4, 5, 6, 12, 13, 14, and 15, in one embodiment, the pump main body 1 comprises an inner housing 12. The inner housing 12 has an inner-housing top wall 120, a first inner-housing sidewall 121 and a second inner-housing sidewall 122. The inner-housing top wall 120 has a first through-hole 120*a*, the first inner-housing sidewall 121 and the second inner-housing sidewall 122 being respectively connected at the inner-housing top wall 120, wherein the inner wall of the first inner-housing sidewall 121 defines an access channel 121*a* which communicates with the first through-hole 120*a*. The second inner-housing sidewall 122 encircles the first inner-housing sidewall 121. The outer wall of the first inner-housing sidewall 121, the inner wall of the second inner-housing sidewall 122, and the inner-housing top wall 120 define a first chamber 1*a* with a first opening 1*b*. The press rod 2 has a rod body 20, a connecting portion 22 and a piston portion 21, and the inner wall of the rod body 20 defines a discharge channel 20*a*. The rod body 20 is provided in the first through-hole 120*a* and the access channel 121*a* in a penetrating manner. The piston portion 21 is provided in the first chamber 1*a*, and slidably contacts with the outer wall of the first inner-housing sidewall 121 and the inner wall of the second inner-housing sidewall 122 in a sealing manner respectively, such that a first gas chamber 12*a* and a second gas chamber 12*b* is separated in the first chamber 1*a*, wherein the first gas chamber 12*a* is a sealed chamber collectively defined by the piston portion 21, the inner-housing top wall 120, the outer wall of the first inner-housing sidewall 121 and the inner wall of the second inner-housing sidewall 122, and the second gas chamber 12*b* communicates with the first opening 1*b*. One end of the connecting portion 22 is connected with the rod body 20, and the other end extends into the second gas chamber 12*b* via the first opening 1*b* and is connected with the piston portion 21. The rod body 20 is configured to be pressed, so as to drive the piston portion 21 to expand the first gas chamber 12*a* and compress the second gas chamber 12*b*, so that the contents 800 in the container body 91 are discharged through the discharge channel 20*a*. The piston portion 21 is configured to rebound under action of the resultant force of the gas pressure in the first gas chamber 12*a* and the gas pressure in the second gas chamber 12*b*, so as to drive the rod body 20 to rebound, so that the rod body 20 is adapted to be re-pressed.

Figure 3:
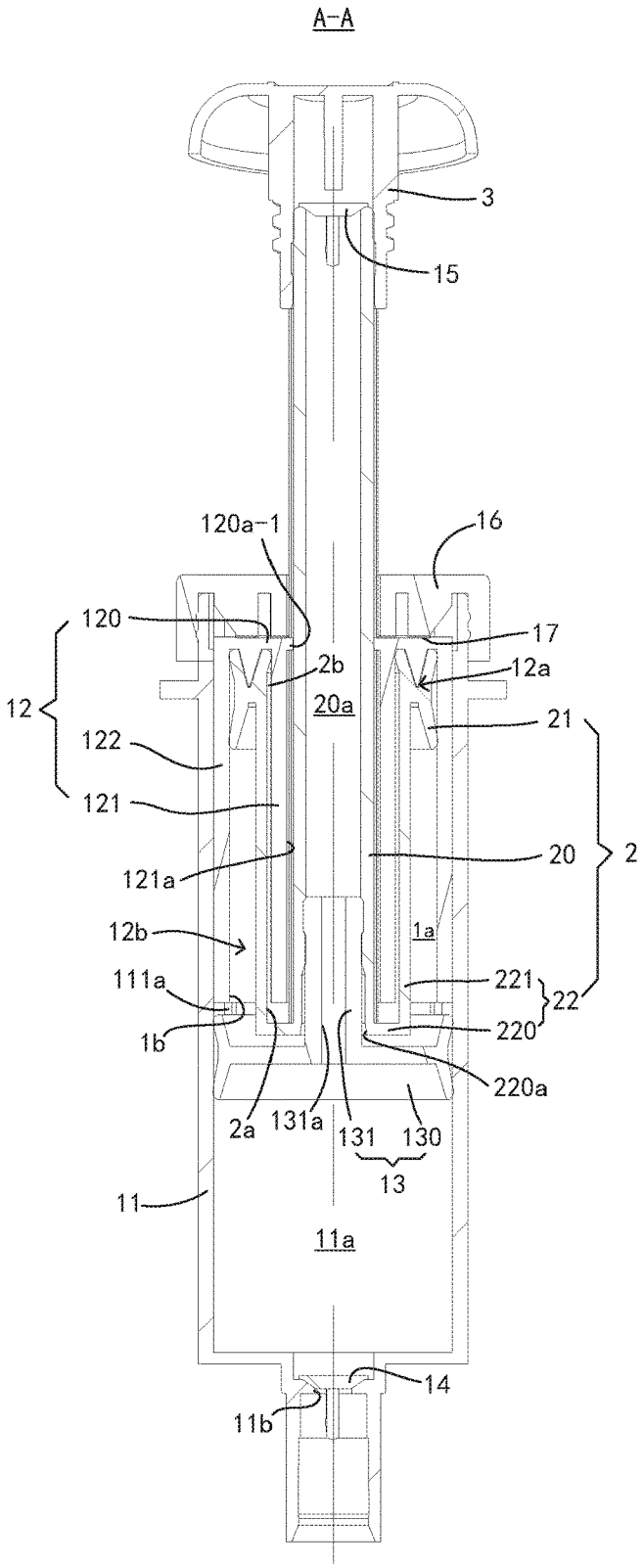
FIG. 3 is a sectional view taken along the line A-A in FIG. 2, in which the press rod is at the press-down initial position.
Figure 4:
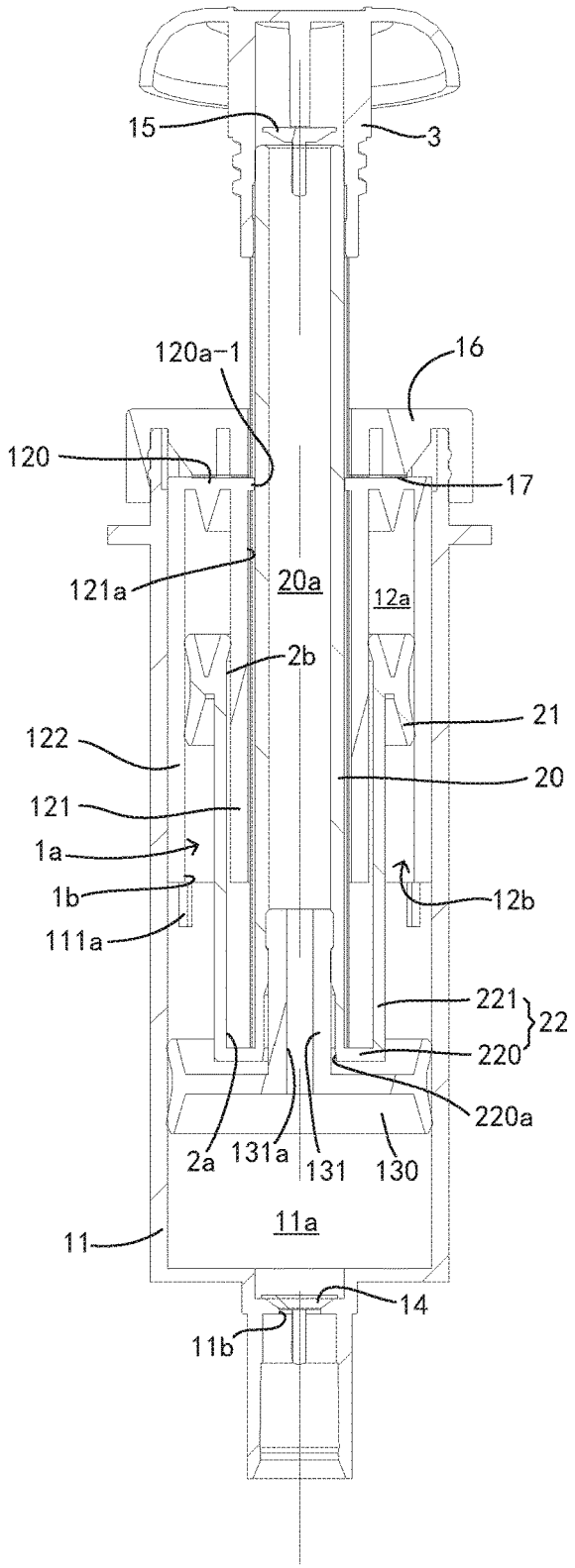
FIG. 4 is a sectional view of the pump assembly, in which the press rod is at the press-down midway position.
Figure 5:
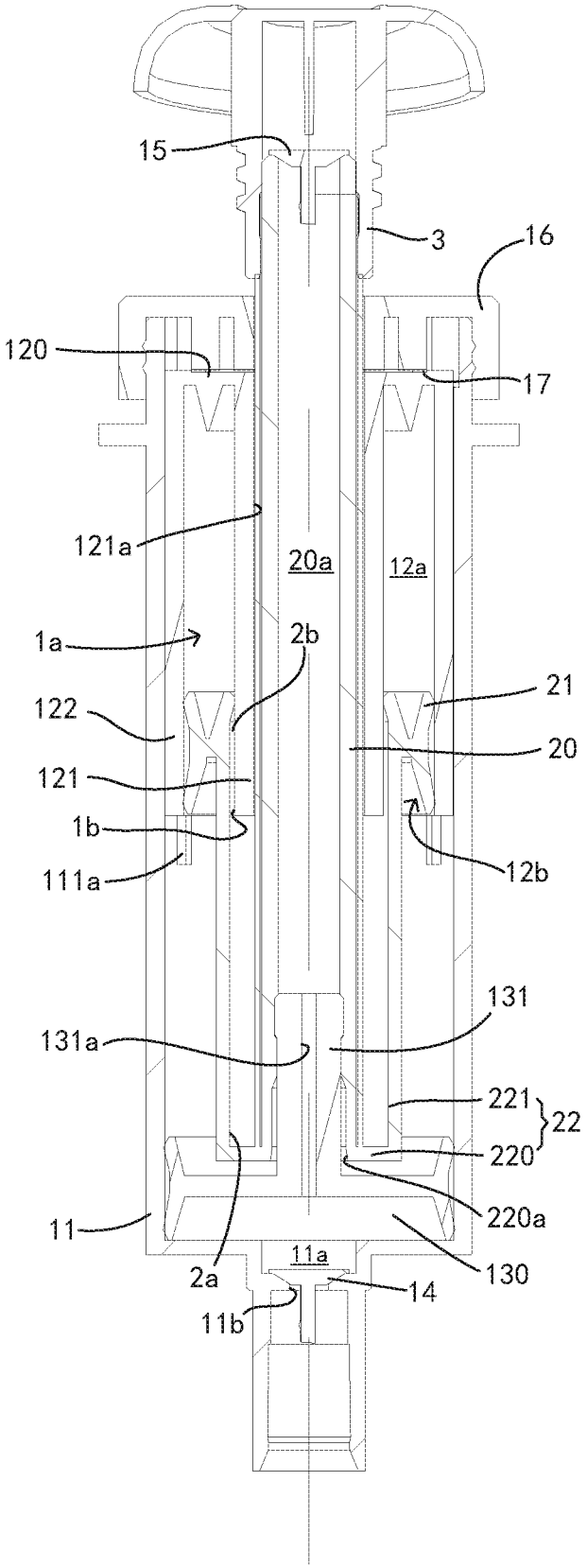
FIG. 5 is a sectional view of the pump assembly, in which the press rod is at the press-down end position.
Figure 6:
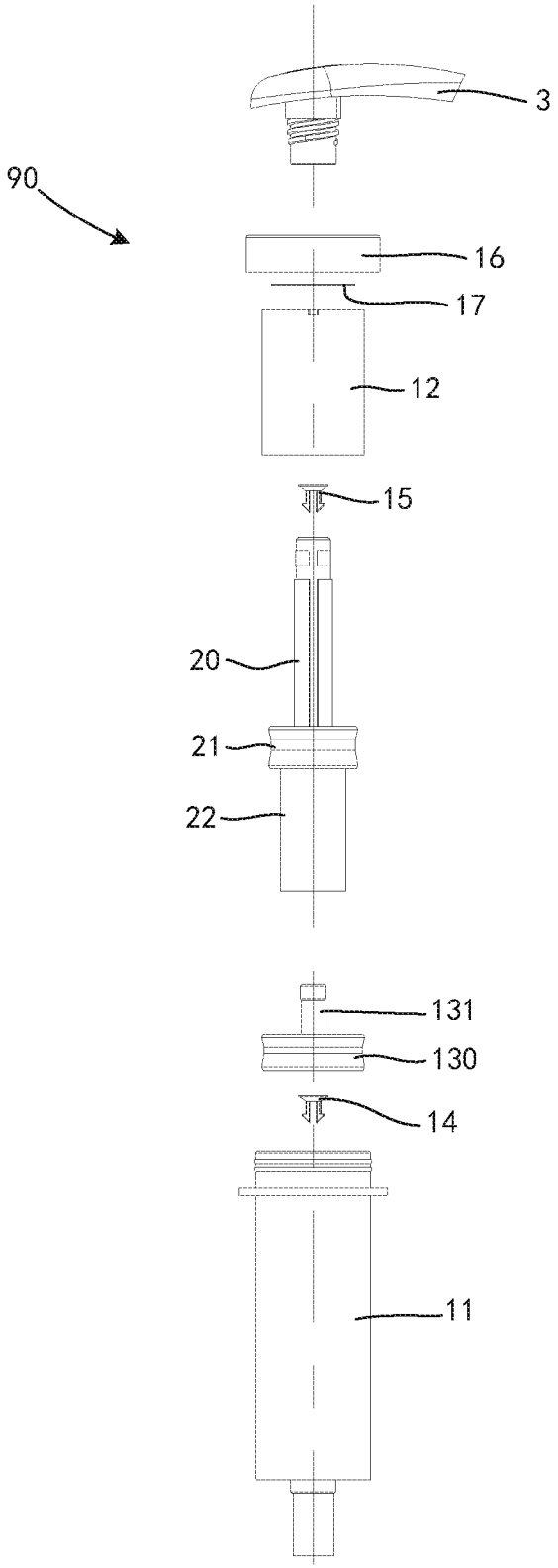
FIG. 6 is an exploded view of the pump assembly.
Figure 7:
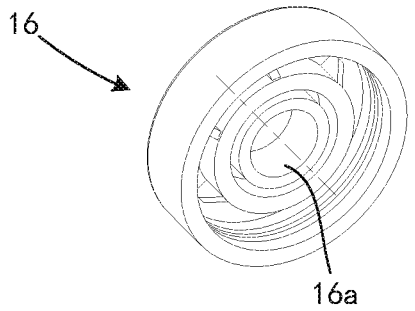
FIG. 7 is a schematic view of the press cover, showing the bottom surface of the press cover.
Figure 8:
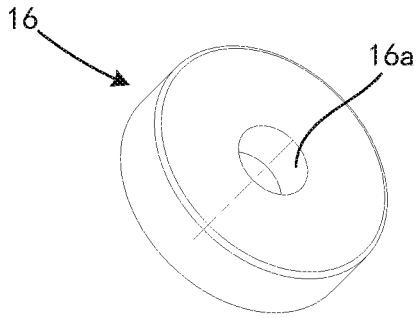
FIG. 8 is a schematic view of the press cover, showing the top surface of the press cover.
Figure 9:
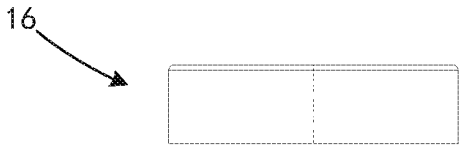
FIG. 9 is a front view of the press cover.
Figure 10:
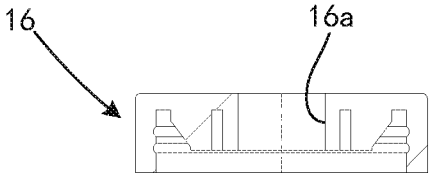
FIG. 10 is a sectional view of the press cover.
Figure 11:
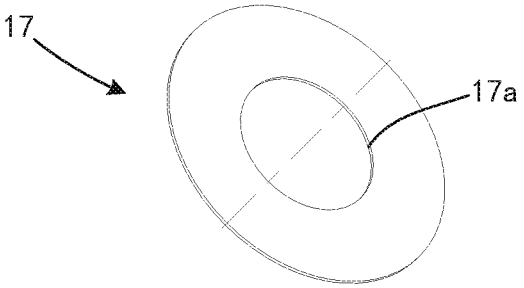
FIG. 11 is a schematic view of the gasket.

In FIG. 3, since the piston portion 21 is at the press-down initial position, the first gas chamber 12*a* is shaped as an annular slit. As the piston portion 21 is pressed down, as shown in FIGS. 4, and 5, the first gas chamber 12*a* is gradually expanded, to become larger.

Since the outer wall of the first inner-housing sidewall 121, the inner wall of the second inner-housing sidewall 122 and the inner-housing top wall 120 define the first chamber 1*a* with the first opening 1*b*, and the gas chamber 12*a* of the first chamber 1*a* is a sealed chamber collectively defined by the piston portion 21, the inner-housing top wall 120, the outer wall of the first inner-housing sidewall 121 and the inner wall of the second inner-housing sidewall 122, the formation of the sealed chamber does not require an additional sealing ring, thereby reducing the risk of gas leakage due to aging of the sealing ring.

Gas, such as air, is present both in the first gas chamber 12*a* and the second gas chamber 12*b*. During being pressed down, the rod body 20 drives the piston portion 21 to move inside the first chamber 1*a*, such that the volume of the first gas chamber 12*a* increases, that is, the first gas chamber 12*a* is expanded, and the volume of the second gas chamber 12*b* decreases, that is, the second gas chamber 12*b* is compressed.

That the first gas chamber 12*a* and/or the second gas chamber 12*b* are sealed cavities comprises three specific embodiments: the first gas chamber 12*a* and the second gas chamber 12*b* are both sealed cavities; the first gas chamber 12*a* is an unsealed chamber, e.g., communicating with the atmosphere, and the second gas chamber is a sealed chamber; and, the first gas chamber 12*a* is a sealed chamber, and the second gas chamber 12*b* is an unsealed chamber, e.g., communicating with the atmosphere.

In the first embodiment described above, as the rod body 20 is pressed down, the gas pressure in the first gas chamber 12*a* decreases, and the gas pressure in the second gas chamber 12*b* increases. As a result, the gas pressure in the first gas chamber 12*a* is smaller than the gas pressure in the second gas chamber 12*b*, so that the piston portion 21 can rebound under action of the resultant force of the gas pressure in the first gas chamber 12*a* and the gas pressure in the second gas chamber 12*b*, so as to drive the rod body 20 to rebound. In this embodiment, neither the first gas chamber 12*a* nor the second gas chamber 12*b* is in gas communication with the outside.

In the second embodiment described above, as the rod body 20 is pressed down, the gas pressure in the first gas chamber 12*a* can remain unchanged and can always be equal to the pressure of the atmosphere, and the gas pressure in the second gas chamber 12*b* increases. As a result, the gas pressure in the first gas chamber 12*a* is smaller than the gas pressure in the second gas chamber 12*b*, so that the piston portion 21 can rebound under action of the resultant force of the gas pressure in the first gas chamber 12*a* and the gas pressure in the second gas chamber 12*b*, so as to drive the rod body 20 to rebound. In this embodiment, the first gas chamber 12*a* is in gas communication with the outside, and the second gas chamber 12*b* is not in gas communication with the outside.

In the third embodiment described above, as the rod body 20 is pressed down, the gas pressure in the first gas chamber 12*a* decreases, and the gas pressure in the second gas chamber 12*b* can remain unchanged and can always be equal to the pressure of the atmosphere. As a result, the gas pressure in the first gas chamber 12*a* is smaller than the gas pressure in the second gas chamber 12*b*, so that the piston portion 21 can rebound under action of the resultant force of the gas pressure in the first gas chamber 12*a* and the gas pressure in the second gas chamber 12*b*, so as to drive the rod body 20 to rebound. In this embodiment, the rod body 20 is easily pressed down in place, which can improve the user's use experience. In this embodiment, the second gas chamber 12*b* is in gas communication with the outside, and the first gas chamber 12*a* is not in gas communication with the outside.

In a more specific embodiment, as shown in FIGS. 3, 4, and 5, the pump main body 1 has a gas guide channel 111*a* which communicates with the second gas chamber 12*b*. The second gas chamber 12*b* discharges out or sucks in the gas through the gas guide channel 111*a*. The gas guide channel 111*a* can communicate with the atmosphere, so that the second gas chamber 12*b* communicates with the atmosphere.

In the embodiments described above, since the piston portion 21 can rebound under action of the resultant force of the gas pressure in the first gas chamber 12*a* and the gas pressure in the second gas chamber 12*b*, so as to drive the rod body 20 to rebound, the pump main body 1 does not need to be provided with a spring for rebounding the rod body 20. As a result, the pump assembly 90 can be entirely made of plastic material, and no metal material is mixed, so that the pump assembly 90 is easily recycled.

As shown in FIGS. 3, 4, 5, 6, 23, 24, 25, and 26, the pump main body 1 further comprises an outer housing 11 which surrounds the second inner-housing sidewall 122. The outer wall of the second inner-housing sidewall 122 is fitted to the inner wall of the outer housing 11 in a surface-to-surface contact manner, wherein the inner wall of the outer housing 11 is recessed to form a gas guide channel 111*a*. This solution makes the structure of the pump main body 1 compact.

As shown in FIGS. 3, 4, 5, 16, 17, and 18, the connecting portion 22 has a connecting-portion bottom wall 220 and a connecting-portion sidewall 221. The connecting-portion bottom wall 220 has a second through-hole 220*a*. The lower end of the rod body 20 is connected at the connecting-portion bottom wall 220, wherein the second through-hole 220*a* communicates with the discharge channel 20*a*. One end of the connecting portion 221 is connected with the connecting-portion bottom wall 220, and the other end extends into the second gas chamber 12*b* via the first opening 1*b* and is connected with the piston portion 21.

In a more specific embodiment, the connecting-portion sidewall 221 encircles the rod body 20. The outer wall of the rod body 20, the inner wall of the connecting-portion sidewall 221, and the connecting-portion bottom wall 220 define a second chamber 2*a* with a second opening 2*b*. The first inner-housing sidewall 121 extends into the second chamber 2*a* via the second opening 2*b*. This solution helps to reduce the length of the pump main body 1.

As shown in FIGS. 3, 4, 5, 19, 20, 21, and 22, in one embodiment, the pump main body 1 further comprises a piston member 13 which has a piston body 130 and a liquid guide tube 131. The liquid guide tube 131 has a liquid guide channel 131*a*. The piston body 130 is slidably fitted to the inner wall of the outer housing 11 in a sealing manner, to define a contents chamber 11*a* in the outer housing 11. One end of the liquid guide tube 131 is connected with the piston body 130, wherein one end of the liquid guide channel 131*a* communicates with the contents chamber 11*a*. The other end of the liquid guide tube 131 extends into the second through-hole 220*a* and the discharge channel 20*a*, and is fixedly connected with the inner wall of the rod body 20 in a sealing manner, wherein the other end of the liquid guide channel 131*a* communicates with the discharge channel 20*a*. This embodiment gives out a technical solution for sucking the contents 800 into the pump and out of the outer housing 11.

As shown in FIGS. 12, 13, 23, and 26, a protrusion 122*a* is provided on the outer wall of the second inner-housing sidewall 122. The inner wall of the outer housing 11 is recessed to form a hang slot 111*b*. The gas guide channel 111*a* extends along the axial direction of the outer housing 11, the hang slot 111*b* extends along the circumferential direction of the outer housing 11, and the gas guide channel 111*a* communicates with the hang slot 111*b*. The protrusion 122*a* is slidingly fitted to the gas guide channel 111*a* in the axial direction of the outer housing 11 and slidingly fitted to the hang slot 111*b* in the circumferential direction of the outer housing 11. This solution can enable the inner housing 12 to slide to the bottom of the outer housing 11 along the gas guide channel 111*a* in the unused state, e.g. the transported state, reducing the volume. As needed, the inner housing 12 slides to the top of the outer housing 11 and rotates to engage with the hang slot 111*b*.

Figure 23:
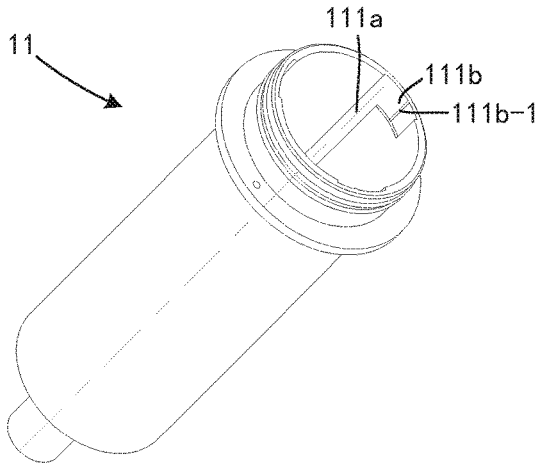
FIG. 23 is a schematic view of the outer housing, showing the top surface of the outer housing.
Figure 24:
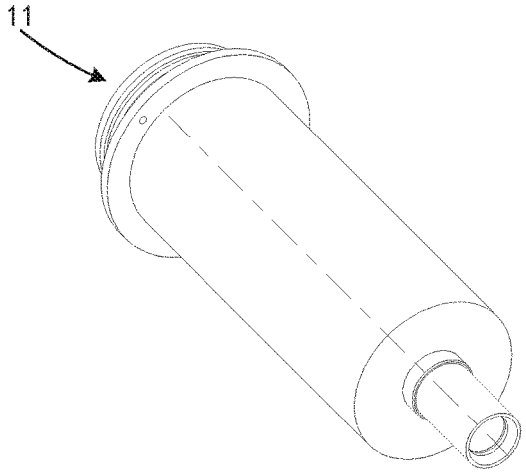
FIG. 24 is a schematic view of the outer housing, showing the bottom surface of the outer housing.
Figure 26:
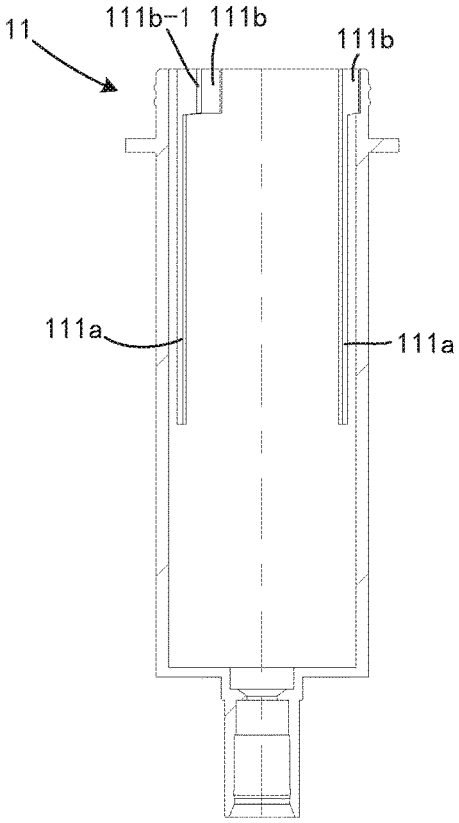
FIG. 26 is a sectional view of the outer housing.
Figure 27:
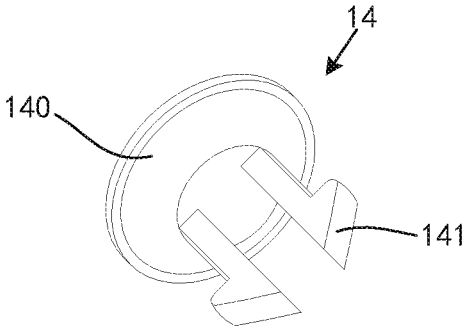
FIG. 27 is a schematic view of the first one-way valve body.
Figure 28:
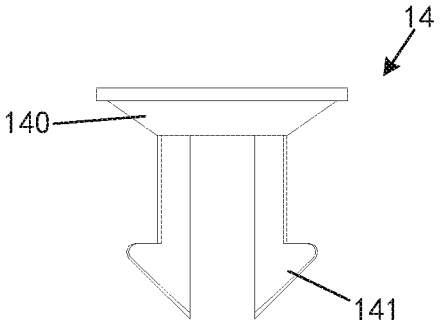
FIG. 28 is a front view of the first one-way valve body.

In a more specific embodiment, as shown in FIGS. 23, and 26, a protruding line 111*b*-1 is provided on the bottom surface of the hang slot 111*b*, and the protruding line 111*b*-1 is configured to engage with the protrusion 122*a* in a clasping manner, to prevent the protrusion 122*a* from exiting the hang slot 111*b*.

Figure 16:
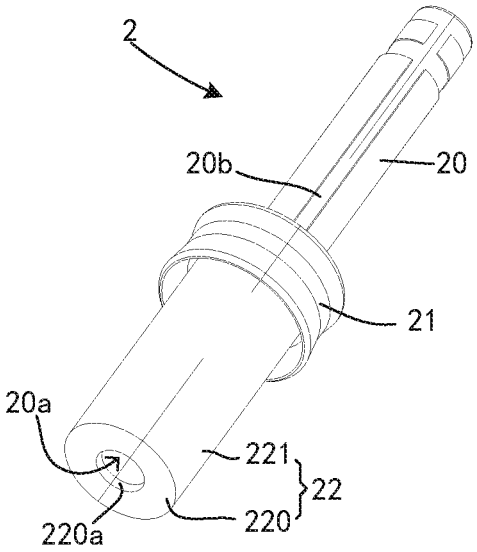
FIG. 16 is a schematic view of the press rod.
Figure 17:
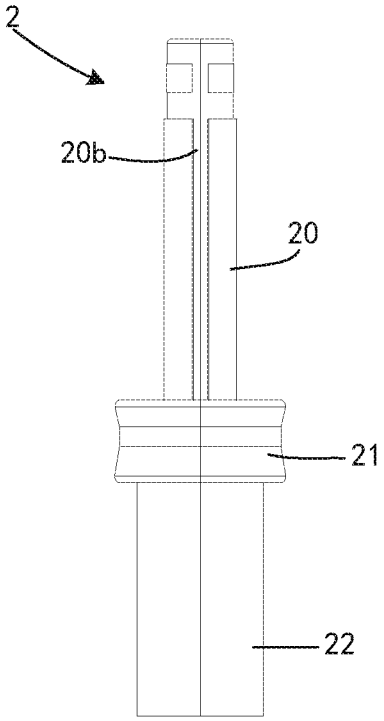
FIG. 17 is a front view of the press rod.
Figure 18:
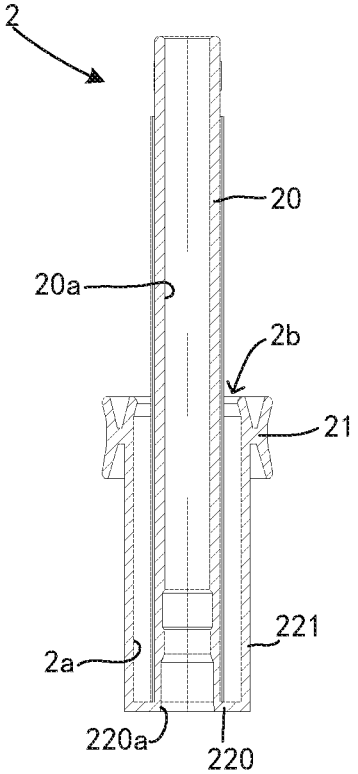
FIG. 18 is a sectional view of the press rod.
Figure 19:
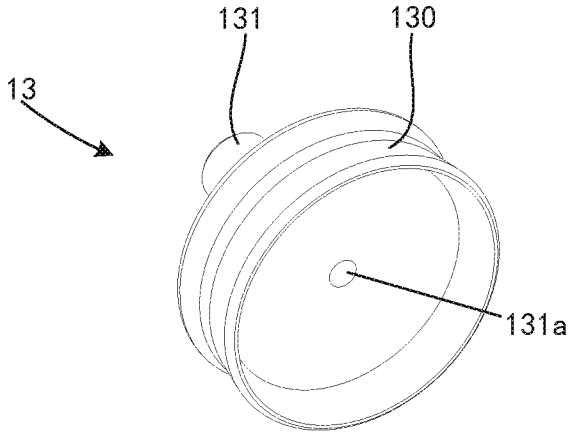
FIG. 19 is a schematic view of the piston member, showing the bottom surface of the piston member.
Figure 20:
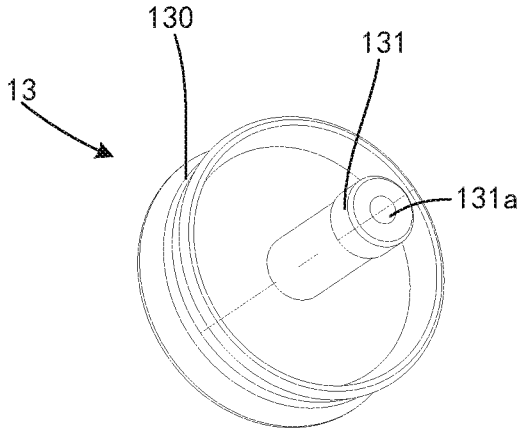
FIG. 20 is a schematic view of the piston member, showing the top surface of the piston member.
Figure 21:
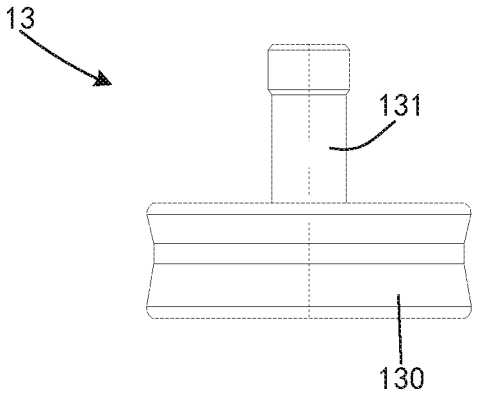
FIG. 21 is a front view of the piston member.
Figure 22:
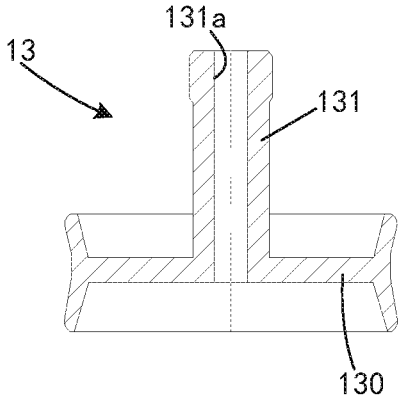
FIG. 22 is a sectional view of the piston member.

In one embodiment, as shown in FIGS. 16, and 17, the inner wall of the first through-hole 120*a* and/or the inner wall of the first inner-housing sidewall 121 are provided with teeth 120*a*-1. The outer wall of the rod body 20 has a slide slot 20*b*, which extends along the axial direction of the rod body 20 and is slidingly fitted to the teeth 120*a*-1. The rod body 20 is configured to be rotated in the radial direction, thereby driving the inner housing 12 to rotate.

As shown in FIGS. 3, 4, 5, 6, 27, and 28, the pump main body 1 further comprises a first one-way valve body 14. The outer housing 11 has a contents inlet 11*b* which communicates with the contents chamber 11*a*. The first one-way valve body 14 is provided on the contents inlet 11*b*, to allow the contents 800 in the container body 91 to flow into the contents chamber 11*a* in one way.

Still referring to FIGS. 3, 4, 5, 6, 27, and 28, the pump main body 1 further comprises a second one-way valve body 15. The second one-way valve body 15 is provided at the upper end of the rod body 20, to allow the contents 800 in the discharge channel 20 to flow out of the discharge channel 20*a* in one way.

The cap 3 is connected with the upper end of the rod body 20, to prevent the second one-way valve body 15 from falling off the upper end of the rod body 20. The connection of the cap 3 and the rod body 20 can be a screwed connection. The cap 3 communicates with the discharge channel 20*a*, to lead out the contents 800 flowing out of the discharge channel 20*a*.

Referring to FIGS. 6, 7, 8, 9, and 10, the pump main body 1 further comprises a press cover 16 screwed to the upper end of the outer housing 11, to prevent the inner housing 12 from falling out of the inside of the outer housing 11.

As shown in FIGS. 3, 4, 5, 6, and 11, the pump main body 1 further comprises a gasket 17 provided between the upper surface of the inner-housing top wall 120 of the inner housing 12 and the press cover 16.

Figure 12:
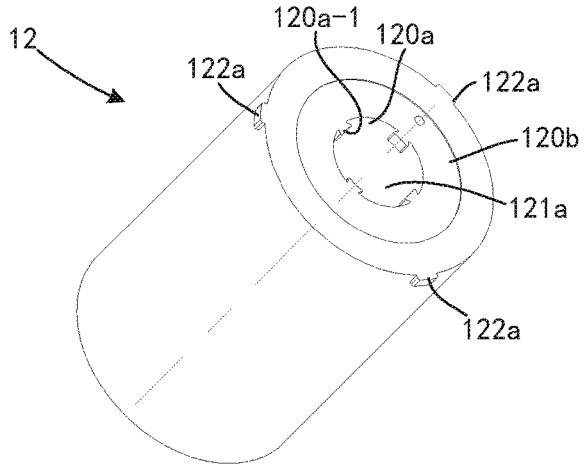
FIG. 12 is a schematic view of the inner housing, showing the top surface of the inner housing.
Figure 13:
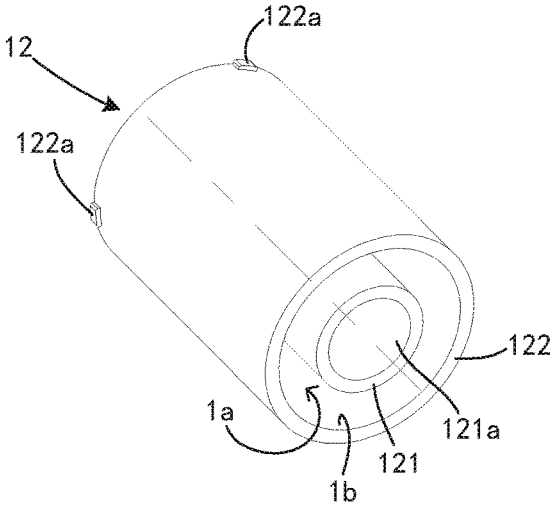
FIG. 13 is a schematic view of the inner housing, showing the bottom surface of the inner housing.
Figure 14:
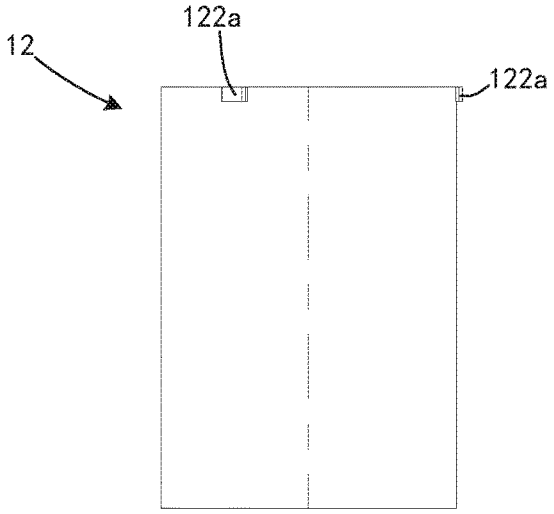
FIG. 14 is a front view of the inner housing.
Figure 15:
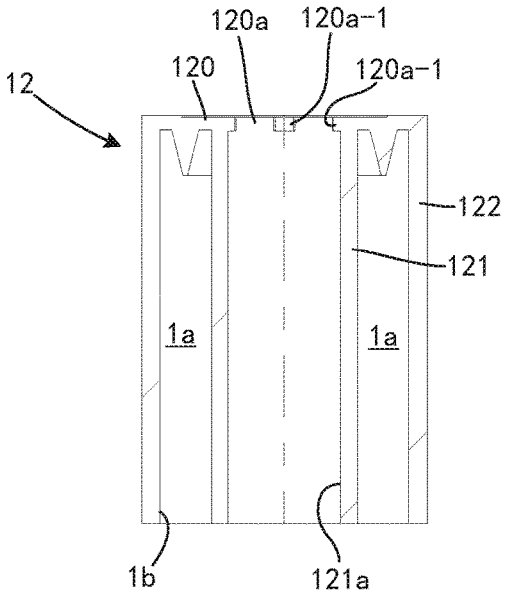
FIG. 15 is a sectional view of the inner housing.

More specifically, as shown in FIG. 12, the upper surface of the inner-housing top wall 120 has a recess 120*b* in which the gasket 17 is provided.

The press cover 16 has a press-cover through-hole 16*a*, and the gasket 17 has a gasket through-hole 17*a*. The press-cover through-hole 16*a* and the gasket through-hole 17*a* allow the rod body 20 to pass therethrough.

FIGS. 3, 4, and 5 show the pressing-down and rebounding process of the press rod 2.

Referring first to FIG. 3, the press rod 2 is at a press-down initial position. The gas pressures in the first gas chamber 12*a* and the second gas chamber 12*b* can be equal, and can be both the atmospheric pressure. The contents 800 or air is stored in the contents chamber 11*a*. The tapered body 140 of the first one-way valve body 14 is fitted to the contents inlet 11*b* in a tapered-surface manner, such that the contents inlet 11*b* is at a closed state. The structure of the second one-way valve body 15 is the same as that of the first one-way valve body 14, and also abuts at the upper end of the rod body 20 under action of gravity. The press rod 2, subject to the external force, starts to be pressed down from the press-down initial position.

Then referring to FIG. 4, the press rod 2 is at a press-down midway position. As the press rod 2 is pressed down, the pressure of the gas in the first gas chamber 12*a* starts to decrease, the pressure of the gas in the second gas chamber 12*b* is equal to the atmospheric pressure, and a gas pressure difference is generated between the first gas chamber 12*a* and the second gas chamber 12*b*. During this, the tapered body 140 of the first one-way valve body 14 maintains being fitted to the contents inlet 11*b* in a tapered-surface manner, such that the contents inlet 11*b* is at a closed state, whereas the second one-way valve body 15 is lifted up under action of the pressure of the contents 800 or air, so as to open the discharge channel 20*a*.

Then referring to FIG. 5, the press rod 2 is at a press-down end position. At this time, the contents 800 or air in the content chamber 11*a* has been discharged out of the contents chamber 11*a* to the maximum extent. The pressure of the gas in the first gas chamber 12*a* is decreased to a minimum value, and the gas pressure difference between the first gas chamber 12*a* and the second gas chamber 12*b* reaches a maximum value. The contents inlet 11*b* is at a closed state, and the second one-way valve 15 also abuts at the upper end of the rod body 20 under action of gravity. After the external force, to which the press rod 2 is subject, is removed, the piston portion 21 can rebound under action of the resultant force of the gas pressure in the first gas chamber 12*a* and the gas pressure in the second gas chamber 12*b*, so as to drive the press rod 2 to start rebounding from the press-down end position.

Figure 25:
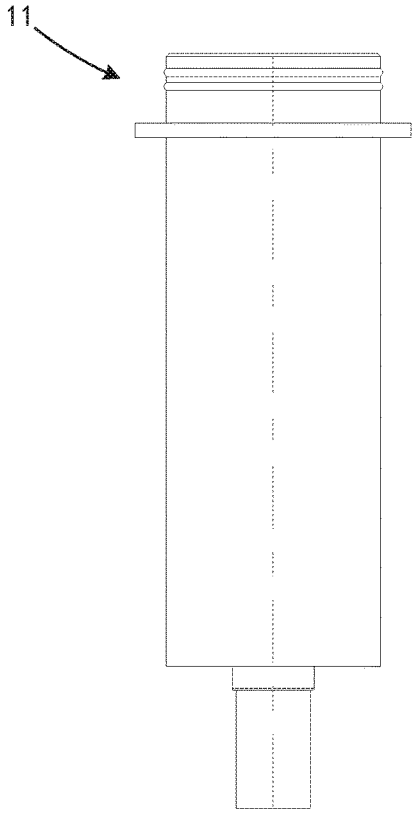
FIG. 25 is a front view of the outer housing.

The press rod 2 can rebound to the press-down initial position shown in FIGS. 25, and 26, such that the press rod 2 is adapted to be re-pressed. During multiple times of pressing and rebounding of the press rod 2, the contents 800 or air in the container body 91 is discharged out of the container body 91. During rebounding of the press rod 2, the second one-way valve body 15 abuts at the upper end of the rod body 20 under action of the outside gas pressure, thereby closing the discharge channel 20*a*, and the first one-way valve body 14 is lifted up to open the contents inlet 11*b*, thereby sucking the contents 800 or air into the contents chamber 11*a*.

When used for the first time, the cap 3 is pressed down, so as to drive the press rod 2 to move down, and the air in the contents chamber 11*a* is pushed by the piston member 13 and discharged out through the liquid guide channel 131*a* and the discharge channel 20*a*.

Once the cap 3 is released, the press rod 2 rebounds to the position before pressed by the external force since the first gas chamber 12*a* is at a negative pressure state. Since the piston portion 21 and the rod body 20 are connected by the connecting portion 22, and the liquid guide tube 131 of the piston member 13 is mounted and inserted into the bottom of the rod body 20 and is connected with the inner wall of the rod body 20 in a sealing manner, the rebounding of the press rod 2 causes the piston member 13 to move upward inside the outer housing 11, such that a negative pressure occurs in the contents chamber 11*a*, and the first one-way valve body 14 is sucked up by the negative pressure to open the contents inlet 11*b* of the outer housing 11, and at the same time, the negative pressure causes the contents 800 in the container body 91 to enter the contents chamber 11*a* through the extension pipe 92.

When the cap 3 is re-pressed down, the piston member 13 connected to the rod body 20 compresses the contents chamber 11*a* downward inside the outer housing 11, such that the contents 800 enters the cap 3 via the liquid guide channel 131*a* of the liquid guide tube 131 and the discharge channel 20*a* of the rod body 20, and is pumped out from the outlet of the cap 3.

This disclosure has been disclosed as above in the preferred embodiments, but it is not intended to limit this disclosure, and any possible changes and modifications may be made by the skilled in the art without departing from the spirit and scope of this disclosure. Therefore, any modification, equivalent variations, and embellishments to the above embodiments, without departing from the content of the technical solution of this disclosure or in accordance with the technical essence of this disclosure, are all incorporated in the protection scope defined in the claims of this disclosure.

The invention claimed is:

1. A pump assembly, adapted to be mounted on a container body, comprising a pump main body and a press rod, wherein, the pump main body comprises an inner housing;

the inner housing has an inner-housing top wall, a first inner-housing sidewall and a second inner-housing sidewall; the inner-housing top wall has a first through-hole, the first inner-housing sidewall and the second inner-housing sidewall being respectively connected at the inner-housing top wall, wherein an inner wall of the first inner-housing sidewall defines an access channel which communicates with the first through-hole; the second inner-housing sidewall encircles the first inner-housing sidewall; an outer wall of the first inner-housing sidewall, an inner wall of the second inner-housing sidewall and the inner-housing top wall define a first chamber with a first opening;

the press rod has a rod body, a connecting portion and a piston portion, an inner wall of the rod body defines a discharge channel; the rod body is provided in the first through-hole and the access channel in a penetrating manner; the piston portion is provided in the first chamber and slidably contacts the outer wall of the first inner-housing sidewall and the inner wall of the second inner-housing sidewall in a sealing manner respectively, such that a first gas chamber and a second gas chamber are separated in the first chamber, wherein the first gas chamber is a sealed chamber collectively defined by the piston portion, the inner-housing top wall, the outer wall of the first inner-housing sidewall and the inner wall of the second inner-housing sidewall, and the second gas chamber communicates with the first opening; one end of the connecting portion is connected with the rod body, and the other end extends into the second gas chamber via the first opening and is connected with the piston portion;

the rod body is configured to be pressed, so as to drive the piston portion to expand the first gas chamber and compress the second gas chamber, so that contents in the container body is discharged via the discharge channel; the piston portion is configured to rebound under action of a resultant force of gas pressure in the first gas chamber and gas pressure in the second gas chamber, so as to drive the rod body to rebound, so that the rod body is adapted to be re-pressed.

2. The pump assembly according to claim 1, wherein the pump main body has a gas guide channel which communicates with the second gas chamber; and gas is discharged from or sucked into the second gas chamber through the gas guide channel.

3. The pump assembly according to claim 2, wherein the pump main body further comprises an outer housing which surrounds the second inner-housing sidewall;

an outer wall of the second inner-housing sidewall is fitted to an inner wall of the outer housing in a surface-to-surface contact manner, wherein the inner wall of the outer housing is recessed to form the gas guide channel.

4. The pump assembly according to claim 3, wherein a protrusion is provided on the outer wall of the second inner-housing sidewall; the inner wall of the outer housing is recessed to form a hang slot;

the gas guide channel extends along an axial direction of the outer housing, the hang slot extends along a circumferential direction of the outer housing, and the gas guide channel communicates with the hang slot;

the protrusion is slidingly fitted to the gas guide channel in the axial direction of the outer housing, and is slidingly fitted to the hang slot in the circumferential direction of the outer housing.

5. The pump assembly according to claim 4, wherein a protruding line is provided on a bottom surface of the hang slot, and the protruding line is configured to be engaged with the protrusion in a clasping manner, to prevent the protrusion from exiting the hang slot.

6. The pump assembly according to claim 4, wherein an inner wall of the first through-hole and/or the inner wall of the first inner-housing sidewall are provided with teeth;

an outer wall of the rod body has a slide slot, which extends along an axial direction of the rod body and is slidingly fitted to the teeth;

the rod body is configured to be rotated in a radial direction, thereby driving the inner housing to rotate.

7. The pump assembly according to claim 3, wherein the connecting portion has a connecting-portion bottom wall and a connecting-portion sidewall; the connecting-portion bottom wall has a second through-hole;

a lower end of the rod body is connected at the connecting-portion bottom wall, wherein the second through-hole communicates with the discharge channel; one end of the connecting-portion sidewall is connected with the connecting-portion bottom wall, and the other end extends into the second gas chamber via the first opening and is connected with the piston portion.

8. The pump assembly according to claim 7, wherein the connecting-portion sidewall encircles the rod body; an outer wall of the rod body, an inner wall of the connecting-portion sidewall and the connecting-portion bottom wall define a second chamber with a second opening;

the first inner-housing sidewall extends into the second chamber via the second opening.

9. The pump assembly according to claim 7, wherein the pump main body further comprises a piston member which has a piston body and a liquid guide tube; the liquid guide tube has a liquid guide channel;

the piston body is slidably fitted to an inner wall of the outer housing in a sealing manner, to define a contents chamber in the outer housing;

one end of the liquid guide tube is connected with the piston body, wherein one end of the liquid guide channel communicates with the contents chamber; the other end of the liquid guide tube extends into the second through-hole and the discharge channel, and is fixedly connected with an inner wall of the rod body in a sealing manner, wherein, the other end of the liquid guide channel communicates with the discharge channel.

10. A container with contents discharge function, comprising a container body, wherein the container further comprises a pump assembly according to claim 1, the pump assembly being mounted on the container body and configured to discharge contents in the container body.

* * * * *